US008036572B2

(12) United States Patent
Maeda

(10) Patent No.: US 8,036,572 B2
(45) Date of Patent: Oct. 11, 2011

(54) COLOR ELECTROPHOTOGRAPHIC IMAGE FORMING APPARATUS

(75) Inventor: Naoyuki Maeda, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/706,500

(22) Filed: Feb. 16, 2010

(65) Prior Publication Data

US 2010/0239313 A1 Sep. 23, 2010

(30) Foreign Application Priority Data

Mar. 19, 2009 (JP) ..... 2009-069070

(51) Int. Cl.
*G03G 15/04* (2006.01)

(52) U.S. Cl. ..... 399/119; 399/116; 399/223

(58) Field of Classification Search ..... 399/107, 399/110–114, 116, 119, 223
See application file for complete search history.

(56) References Cited

U.S. PATENT DOCUMENTS

| | | | | |
|---|---|---|---|---|
| 5,608,498 | A | 3/1997 | Nagase et al. | |
| 2004/0165910 | A1 * | 8/2004 | Sato et al. | 399/116 |
| 2006/0140673 | A1 * | 6/2006 | Kamimura et al. | 399/119 |

FOREIGN PATENT DOCUMENTS

| | | |
|---|---|---|
| JP | 2002-108050 | 4/2002 |
| JP | 2003-255660 | 9/2003 |
| JP | 2005-181741 | 7/2005 |

OTHER PUBLICATIONS

Japanese Office Action dated Mar. 30, 2010, in Japanese Patent Application No. 2009-069070, and English-language translation thereof.

* cited by examiner

*Primary Examiner* — David Porta
*Assistant Examiner* — Benjamin Schmitt
(74) *Attorney, Agent, or Firm* — Fitzpatrick, Cella, Harper & Scinto

(57) ABSTRACT

A color electrophotographic image forming apparatus including: an opening in a main body; a door opening and closing the opening; a first tray movable between an inside position and an outside position through the opening while removably supporting drum cartridges having photosensitive drums; a second tray movable between the inside position and the outside position through the opening while removably supporting developing cartridges having developing rollers; a transfer member to which toner images are transferred from the photosensitive drums; and a positioning member, which releases, when the door is opened, an engagement between engaging portions of the developing cartridges and engaged portions of the drum cartridges to hold the developing cartridges so that the second tray can be pulled out, and which engages, when the door is closed, the engaging portion with the engaged portion to position the developing cartridges for image formation.

6 Claims, 16 Drawing Sheets

COLOR ELECTROPHOTOGRAPHIC IMAGE FORMING APPARATUS

BACKGROUND OF THE INVENTION

1. Field of the Invention

The present invention relates to a color electrophotographic image forming apparatus, in which a plurality of process cartridges are removably mounted to an apparatus main body to form an image on a recording medium.

2. Related Background Art

With regard to a mounting and dismounting mechanism of the process cartridges with respect to the apparatus main body, the below-mentioned structures are known as the related art. First, the process cartridge is supported by a raising and lowering plate through a guide member capable of expansion and contraction in two stages. The raising and lowering is moved upward or downward while being forwarded and retracted interlocking with a side cover. With this structure, when the side cover is opened, the process cartridge can be directly pulled out after being moved from an image forming position (I) to a pullout position (II) while being raised. Through this pullout operation, when the process cartridge is pulled out to the pullout position, the mounting and dismounting of the process cartridge, and the jam-paper clearing can be conducted (refer to U.S. Pat. No. 5,608,498).

Further, a first cartridge supporting member and a second cartridge supporting member are removably mounted in the apparatus main body. The first cartridge supporting member is constructed so that an intermediate transfer belt unit and a plurality of process cartridges are removably mounted to the first cartridge supporting member. The second cartridge supporting member is constructed so that a plurality of developing cartridges are removably mounted to the second cartridge supporting member (refer to Japanese Patent Application Laid-open No. 2002-108050).

SUMMARY OF THE INVENTION

The present invention achieves further innovation of the above-mentioned related art.

It is an object of the present invention is to provide a color electrophotographic image forming apparatus, which includes a first cartridge supporting member and a second cartridge supporting member, and is capable of positively positioning a developing roller with respect to an electrophotographic photosensitive drum.

Another object of the present invention is to provide a color electrophotographic image forming apparatus capable of improving the mounting and dismounting operability of a drum cartridge and the developing cartridge with respect to the apparatus main body through the provision of the first cartridge supporting member and the second cartridge supporting member.

Further another object of the present invention is to provide a color electrophotographic image forming apparatus capable of improving the operability of mounting and dismounting of the drum cartridge and the developing cartridge with respect to the apparatus main body.

Still another object of the present invention is to provide a color electrophotographic image forming apparatus capable of positively positioning the developing cartridge to the drum cartridge.

In order to solve the above-mentioned objects of the present invention, the present invention provides a color electrophotographic image forming apparatus, in which a plurality of drum cartridges are removably mounted to an apparatus main body to form an image on a recording medium, the color electrophotographic image forming apparatus including:

an opening provided in the apparatus main body;

an openable and closable member, which is moved between a closed position for closing the opening and an open position for opening the opening;

a plurality of drum cartridges each including an electrophotographic photosensitive drum;

a first cartridge supporting member, which removably supports the plurality of drum cartridges, and is moved between an inside position of the apparatus main body and an outside position of the apparatus main body through the opening;

a plurality of developing cartridges each including a developing roller, which corresponds to each of the plurality of drum cartridges;

a second cartridge supporting member, which removably supports the plurality of developing cartridges, and is moved between the inside position of the apparatus main body and the outside position of the apparatus main body;

a transfer member, which is brought into contact with the electrophotographic photosensitive drum so that a toner image formed on the electrophotographic photosensitive drum is transferred from the electrophotographic photosensitive drum to the transfer member;

an engaging portion provided on each of the plurality of developing cartridges;

an engaged portion, which is engageable with the engaging portion, and is provided on each of the plurality of drum cartridges; and positioning means, which releases, when the openable and closable member is moved from the closed position to the open position, an engagement between the engaging portion and the engaged portion, to hold the plurality of developing cartridges in positions from which the plurality of developing cartridges can be pulled out, and which engages, when the openable and closable member is moved from the open position to the closed position, the engaging portion with the engaged portion, to position the plurality of developing cartridges in positions in which the plurality of developing cartridges can serve an image formation.

According to the present invention, the positioning of the developing roller with respect to the electrophotographic photosensitive drum is positively achieved, while incorporating the first cartridge supporting member and the second cartridge supporting member.

According to the present invention, through the provision of the first cartridge supporting member and the second cartridge supporting member, it is possible to improve the mounting and dismounting operability of the drum cartridge and the developing cartridge with respect to the apparatus main body.

According to the present invention, the positioning of the developing cartridge with respect to the drum cartridge is positively achieved.

According to the present invention, the mounting and dismounting operability of the drum cartridge with respect to the apparatus main body, and the mounting and dismounting operability of the developing cartridge with respect to the apparatus main body can be improved.

Further features of the present invention will become apparent from the following description of exemplary embodiments with reference to the attached drawings.

DESCRIPTION OF THE EMBODIMENTS

Figure 1A:
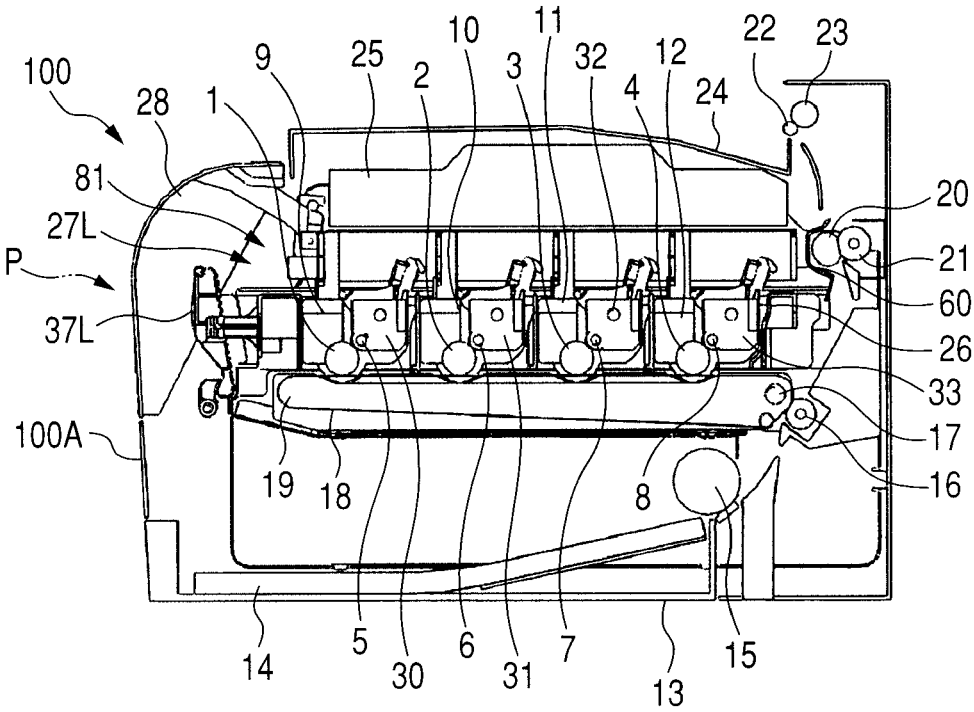
FIGS. 1A and 1B are sectional views illustrating a structure of a laser beam printer according to an embodiment of the present invention.

Now, a color electrophotographic image forming apparatus according to the present invention will be described with reference to the accompanying drawings. However, it should be noted that the dimensions, materials, shapes, their relative positions, etc. of component parts described in this embodiment may appropriately be modified depending on the structure and various conditions of the apparatus to which the present invention is applied, and hence the scope of the present invention is not intended to be limited only thereto unless otherwise specifically described in particular.

The below-mentioned color electrophotographic image forming apparatus refers to one that forms a color image on a recording medium using an electrophotographic image forming process. Then, examples of the color electrophotographic image forming apparatus include, for example, a color electrophotographic copying machine, a color electrophotographic printer (for example, a color laser beam printer and a color LED printer), a color facsimile machine, and a color word processor.

The below-mentioned recording medium refers to one, on which an image is formed by the electrophotographic image forming apparatus, and paper, an OHP sheet, and the like are included therein, for instance.

The below-mentioned cartridge refers to, for example, a process cartridge or a developing cartridge, and contributes, under a state being removably mounted to an apparatus main body of the electrophotographic image forming apparatus, to an image forming process for forming the image on the recording medium.

The below-mentioned process cartridge refers to one, in which at least one of a charging means and a cleaning means each serving as a process means and an electrophotographic photosensitive drum are integrated into a cartridge, and the thus constructed cartridge is removably mounted to the apparatus main body of an electrophotographic image forming apparatus. Therefore, the process cartridge, in which the charging means, or the cleaning means each serving as the process means and the electrophotographic photosensitive drum are integrated into a cartridge, and the thus constructed cartridge is removably mounted to the apparatus main body, is also included in the above-mentioned process cartridge.

The process cartridge, which integrally includes the electrophotographic photosensitive drum and the developing means, is referred to as a so-called integral type. The process cartridge, which integrally includes the electrophotographic photosensitive drum and the process means other than the developing means, is referred to as a so-called separation type. The mounting and dismounting of the process cartridge with respect to the apparatus main body can be performed by a user by himself/herself. Therefore, the maintenance of the apparatus main body can easily be performed. The process means acts on the electrophotographic photosensitive drum. The below-mentioned process cartridge used in the embodiment, to which the present invention is applied, is the above-mentioned separation type.

The developing cartridge refers to one, which includes a developing roller, contains a developer (toner) used to develop an electrostatic latent image formed on the electrophotographic photosensitive drum by the developing roller, and is removably mounted to the main body. The electrophotographic photosensitive drum is provided in the so-called separation type process cartridge (in this case, the process cartridge has no developing means). The developing cartridge also allows mounting and dismounting to and from the main body by the user by her/himself. For that reason, the maintenance of the apparatus main body can easily be performed.

Embodiment 1

General Structure of Image Forming Apparatus

FIG. 1A is a sectional view illustrating a structure of a laser beam printer (hereinafter, simply referred to as "printer") 100, which being a color electrophotographic image forming apparatus according to an embodiment of the present invention.

The printer 100 includes a printer main body 100A as an apparatus main body, which being an image forming apparatus main body. Inside the printer main body 100A, a laser scanner 25, electrophotographic photosensitive drums 1, 2, 3, and 4, and developing rollers 5, 6, 7, and 8 are arranged. Further, inside the printer main body 100A, an intermediate transfer belt (transfer member) 18, a fixing film 20, a pressure roller 21, a paper feeding tray 13, a paper feeding roller 15, and the like are arranged. In this embodiment, four photosensitive drums 1 to 4, and four developing rollers 5, 6, 7, and 8 are provided as well.

Paper (recording medium) 14 stacked and contained inside the tray 13 is fed through the rotation of the paper feeding roller 15 (in the counter clockwise direction in FIG. 1A). Then, the paper 14 is sent to a nip portion between a belt driving roller 17 and a transfer roller 16.

The photosensitive drums 1, 2, 3, and 4 are rotated in the clockwise direction in FIG. 1A, and on their outer circumferential surfaces, electrostatic latent images are sequentially formed by a laser light from the laser scanner 25. Successively, the electrostatic latent images are developed by the developing rollers 5, 6, 7, and 8 to form the toner images on the outer circumferential surfaces of the photosensitive drums 1, 2, 3, and 4. The toner images formed on the photosensitive drums 1, 2, 3, and 4, are transferred onto an intermediate transfer belt 18. When forming a color image, the photosensitive drum 1 is developed with toner of black color, to thereby form a toner image of black color. The photosensitive drum 2 is developed with toner of cyan color, and a toner image of cyan color is formed. The photosensitive drum 3 is developed with toner of magenta color, and a toner image of magenta is formed. The photosensitive drum 4 is developed with toner of yellow color, and a toner image of yellow color is formed. The toner images formed on the respective photosensitive drums are transferred onto the transfer belt 18. Next, the toner images transferred (formed) onto the transfer belt 18 are transferred onto paper 14, which is being sent to the nip portion between the belt driving roller 17 and the transfer roller 16.

In addition, the paper 14, onto which the toner images have been transferred, is sent to a nip portion between a fixing film 20 and a pressure roller 21, whereat the toner images are subjected to heating and pressure to be fixed onto the paper 14. The paper 14 onto which the toner images have been fixed is discharged to a delivery tray 24 by a discharge roller 22 and a discharge rotatable member 23.

The photosensitive drums 1, 2, 3, and 4 are provided inside the drum cartridges 9, 10, 11, and 12, which being the process cartridges. The developing rollers 5, 6, 7, and 8 are provided inside the developing cartridges 30, 31, 32, and 33. The drum cartridges 9, 10, 11, and 12 and the developing cartridges 30, 31, 32, and 33 are removably mounted in the printer main body 100A. The four drum cartridges 9 to 12 and the four developing cartridges 30 to 33 are provided.

The plurality of drum cartridges 9 to 12 correspond to the plurality of developing cartridges 30 to 33, respectively. That is, the drum cartridge 9 corresponds to the developing cartridge 30, and the drum cartridge 10 corresponds to the developing cartridge 31, and the drum cartridge 11 corresponds to the developing cartridge 32, and the drum cartridge 12 corresponds to the developing cartridge 33. Specifically, the developing roller 5 is provided for the photosensitive drum 1. Similarly, the developing roller 6 is provided for the photosensitive drum 2, and the developing roller 7 is provided for the photosensitive drum 3, and the developing roller 8 is provided for the photosensitive drum 4.

An opening 81 is provided in the printer main body 100A. At the forward portion of the opening 81, the front door (an openable and closable member) 28 is attached openable and closable. The door 28 is constructed so as to open and close between a closed position P (see FIG. 1A) at which the opening 81 is closed and an open position Q (see FIG. 1B) at which the opening 81 is opened.

Figure 1B:
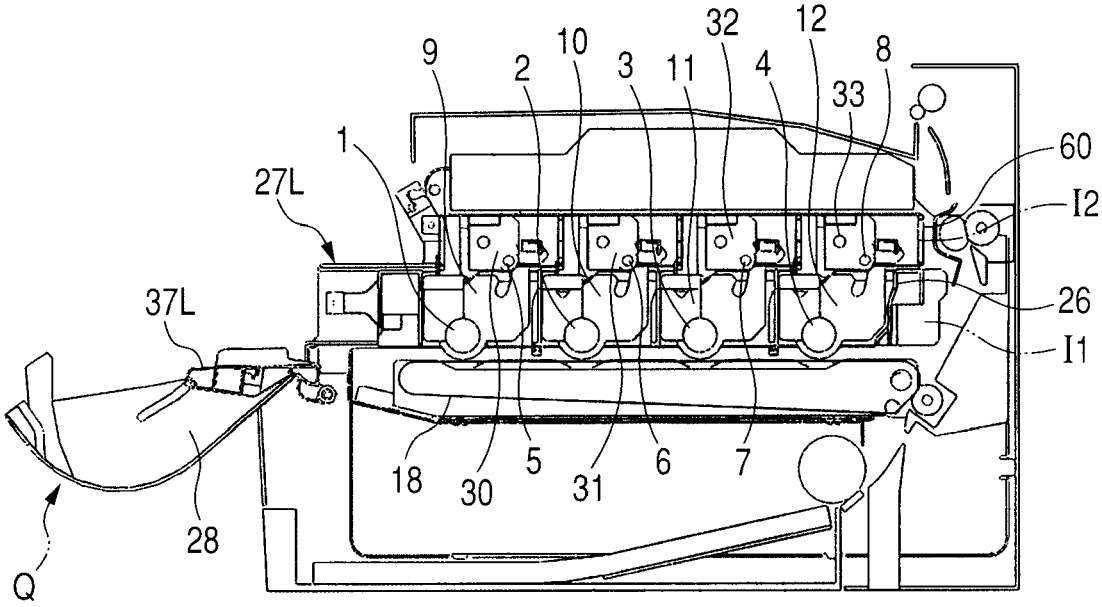

FIG. 1B is a sectional view illustrating a state in which the door 28 is opened. As illustrated in FIG. 1B, when the door 28 is opened so as to assume the open position Q, a connecting arm 37L rotates in the counter clockwise direction. With this operation, the drum cartridge tray (a first cartridge supporting member) 26 is moved obliquely upward to the left (FIG. 1B) together with a rail 27L by a mechanism described below. With this operation, the photosensitive drums 1 to 4 are separated from the transfer belt 18. The developing cartridges 30 to 33 are contained in the developing cartridge tray (a second cartridge supporting member) 60, before the movement of the drum cartridge tray 26. Description of this operation will be described later.

Conversely, when the door 28 is closed from the open position Q to the closed position P (from the state illustrated in FIG. 1B to the state illustrated in FIG. 1A), the connecting arm 37L provided on the door 28 is rotated clockwise. With this rotation, the tray 26 is moved obliquely downward to the right (FIG. 1B) together with the rail 27L. Owing to this, the photosensitive drums 1 to 4 are brought into contact with the transfer belt 18. Under this state, the toner images are transferred onto the transfer belt 18 from the photosensitive drums 1 to 4.

Figure 2A:
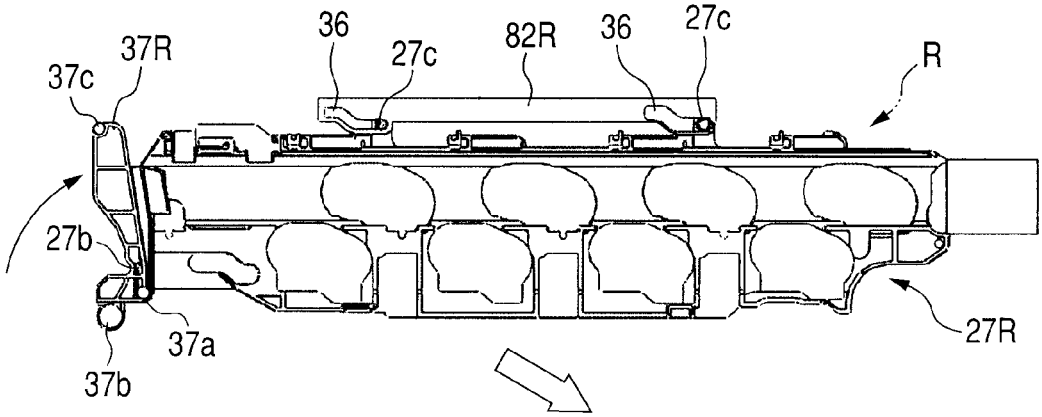
FIGS. 2A and 2B are side views illustrating an operation relation between a rail fixed to a printer main body and a drum cartridge tray.
Figure 2B:
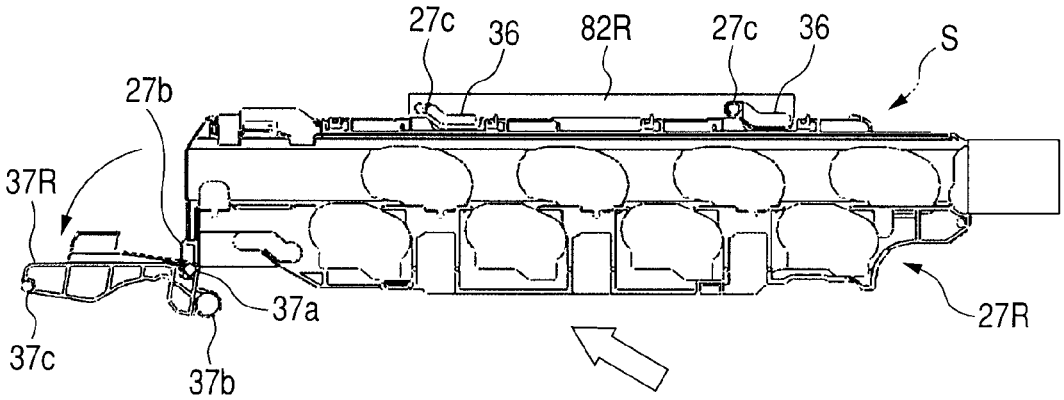

FIGS. 2A and 2B are side views illustrating an operation relation between a rail 27R assembled to a printer main body 100A and a drum cartridge tray 26. The rail 27R is paired with the rail 27L, which are arranged at opposing positions. FIG. 2A is a side view illustrating a state in which the photosensitive drums 1 to 4 are in contact with the transfer belt 18. Under this state, a connecting arm 37R is in an upright state. FIG. 2B is a side view illustrating a state in which the photosensitive drums 1 to 4 are separated from the transfer belt 18. Under this state, the arm 37R is in a lateral falling down state. FIG. 3B is a perspective view illustrating a state in which the tray 26 is pulled out from the printer main body 100A.

The rail 27R and the rail 27L are provided to the printer main body 100A so as to be horizontally movable (refer to FIG. 3B). As illustrated in FIG. 3B, the printer main body 100A is provided with a right frame 82R and a left frame 82L. As illustrated in FIGS. 2A and 2B, the right frame 82R is provided with guide holes 36. A vertically elongated hole 27*b* is provided in the lower portion on the front side of the rail 27R. Besides, two boss portions 27*c* are provided on the upper portion of the rail 27R with a space in the front-rear direction. The guide holes 36 are extended horizontally at the rear side, and are extended obliquely upward toward the front side (in FIGS. 2A and 2B). Therefore, by the engagement of the boss portions 27*c* with the guide holes 36, the rail 27R is moved forward along the guide holes 36. At this time, the rail 27R is moved forward horizontally, and thereafter, is moved obliquely upward (FIG. 2B). Further, when being moved in the rear direction, the rail 27R is moved obliquely downward (FIG. 2A), and then is moved horizontally in the rear direction.

The connecting arm 37R provided on the door 28 includes a shaft 37*a*, a shaft 37*b*, and a shaft 37*c*. The shaft 37*a* is inserted into the hole 27*b* of the rail 27R to be engaged therewith, and the shaft 37*c* is inserted into a front door hole portion 28*c* of the door 28 (refer to FIG. 3B) to be engaged therewith. The shaft 37*b* is received by the right frame 82 R of the printer main body 100A. Thus, the arm 37R is rotatably held about the shaft 37*b*, which is received by the right frame 82R.

The rail 27R is coupled to the arm 37R through the engagement of the hole 27*b* and the shaft 37*a*. When the door 28 is rotated from the closed position P to the open position Q, the shaft 37*c* is guided by the hole portion 28*c*. With this, the arm 37R is shifted from the upright state to the lateral falling down state. In association with this operation, the cartridges 9 to 12 are moved from the contact position R to the separation position S. Conversely, when the door 28 is rotated from the open position Q to the closed position P, the shaft 37*c* is guided by the hole portion 28*c*. With this, the arm 37R is moved from the lateral falling down state to the upright state. In association with this operation, the cartridges 9 to 12 are moved from the separation position S to the contact position R.

Although the rail 27L is not illustrated, the rail 27L is constructed similarly to the rail 27R. Two boss portions 27*c* of the rail 27L are provided on the rail 27L with a space in the front-rear direction. Although the arm 37L is not illustrated, the arm 37L is constructed similarly to the arm 37R. The arm 37L is provided on the left frame 82L of the printer main body 100A.

Figure 3A:
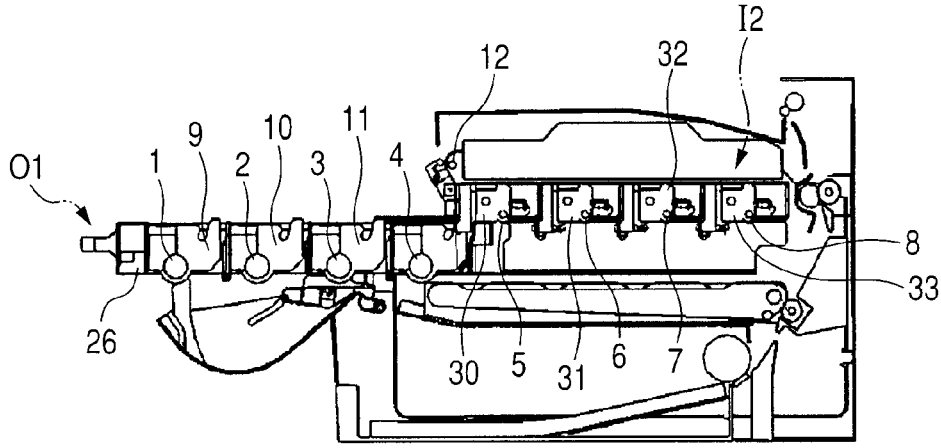
FIGS. 3A and 3B are a sectional view and a perspective view each illustrating a state in which the drum cartridge tray is pulled out from the printer main body.
Figure 3B:
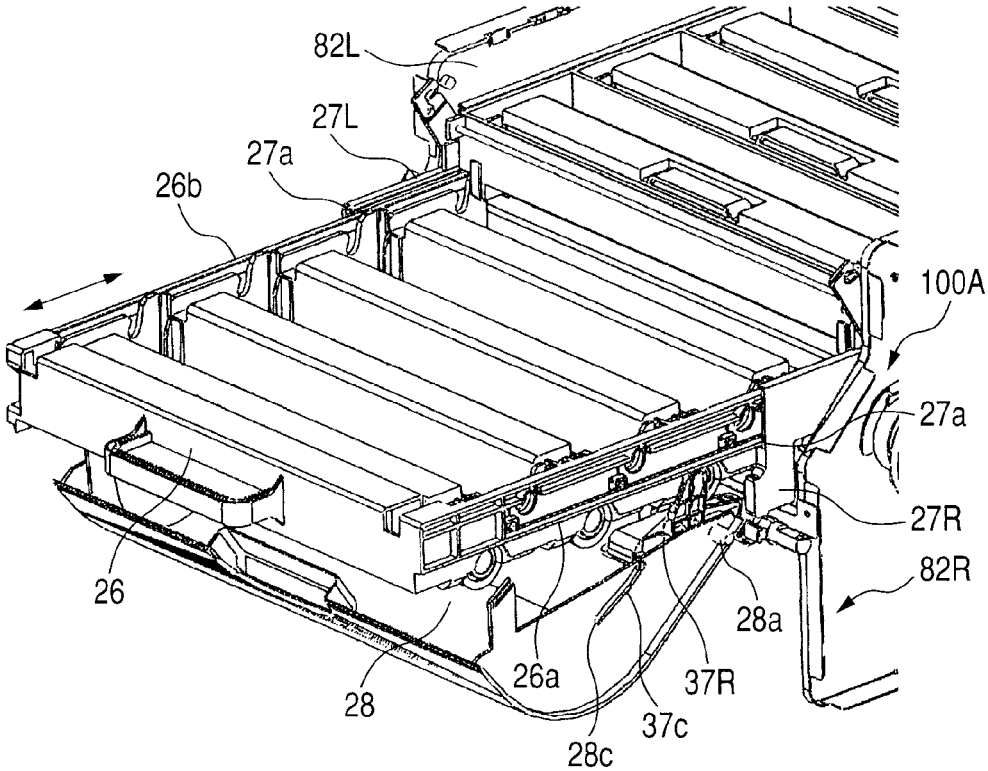

FIG. 3A is a sectional view illustrating a state in which the tray 26 is pulled out from the printer main body 100A. FIG. 3B is a perspective view illustrating a state in which the tray 26 is pulled out from the printer main body 100A. As illustrated in FIG. 3A and FIG. 3B, the tray 26 detachably supports a plurality of the cartridges 9 to 12, and is constructed so as to be moved between an inside position I1 of the printer main body 100A (refer to FIG. 1B) and an outside position O1 thereof (refer to FIG. 3A).

As illustrated in FIG. 3B, the door 28 includes a shaft 28*a* on the right side surface and a hole portion 28*c* having a symmetrical shape. On the left side surface, the door 28 includes a shaft and a hole portion 28*c* having a symmetrical shape. The shaft 28*a* is received by the right frame 82R of the printer main body 100A to be rotatably supported thereby. Further, the other side shaft is received by the left frame 82L of the printer main body 100A to be rotatably supported thereby.

Further, as illustrated in FIG. 3B, inside the printer main body 100A, a pair of the left rail 27L and the right rail 27R, in which the front-rear direction is a longitudinal direction of the rails, are arranged so as to be opposed with each other. The tray 26 is a frame type member, and includes the right side frame 26*a* and the left side frame 26*b*. The frame 26*a* is fitted and inserted into a guide groove portion 27*a* provided inside the rail 27R. The frame 26*b* is fitted and inserted into a guide groove portion 27*a* provided inside the rail 27L. With this structure, the tray 26 is supported with respect to the printer main body 100A between the rails 27L and 27R, and is slidable in an arrow direction (FIG. 3B) by being slid in the guide groove portion 27*a*.

Figure 4A:
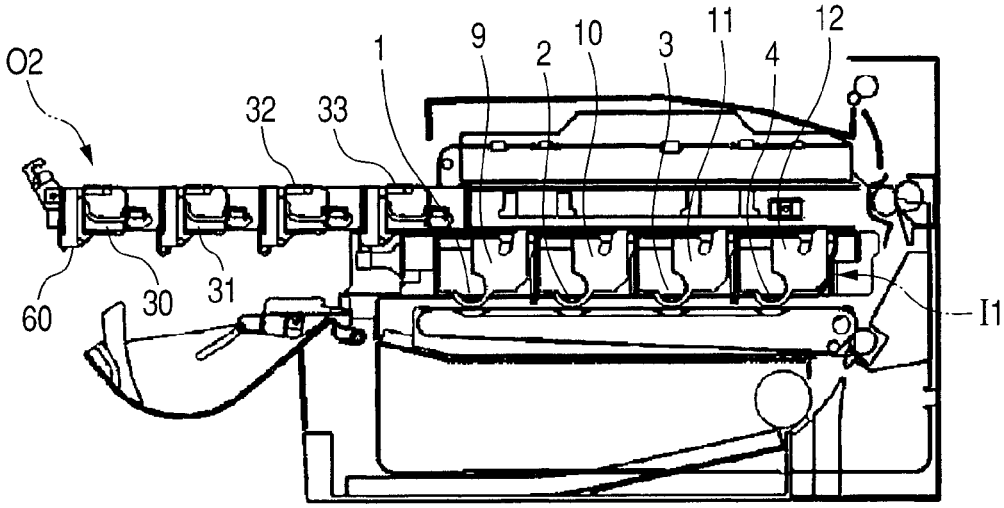
FIGS. 4A and 4B are a sectional view and a perspective view each illustrating a state in which the developing cartridge tray is pulled out from the printer main body.
Figure 4B:
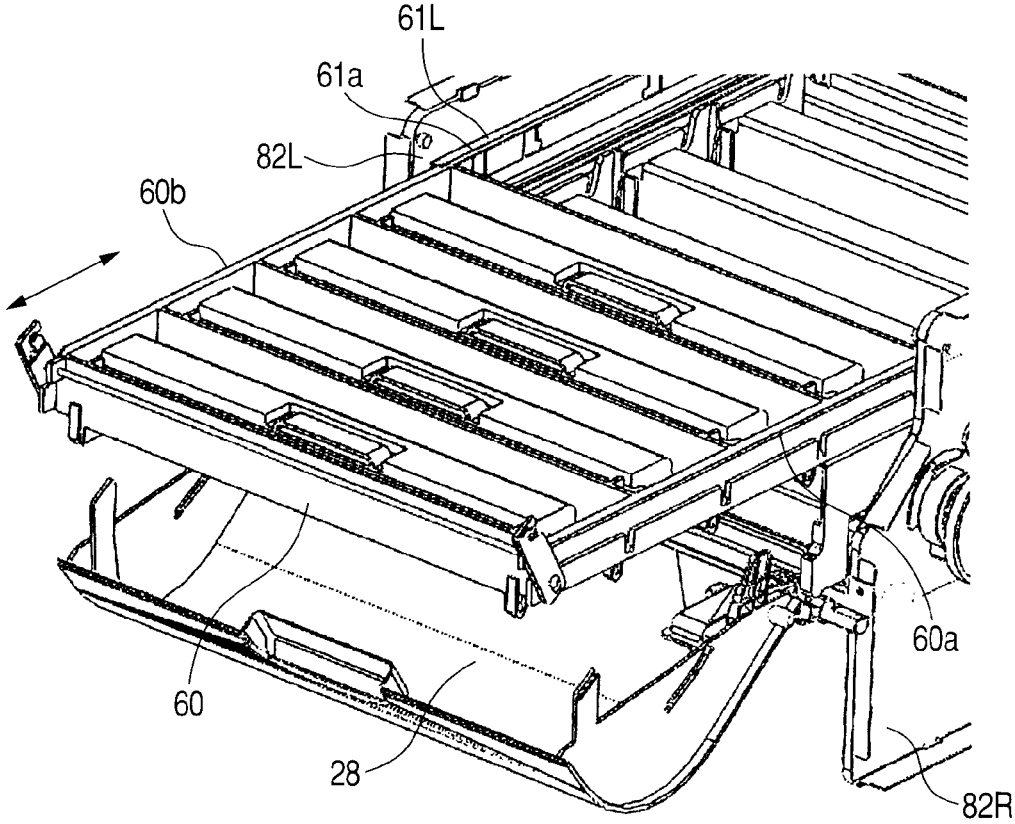

FIG. 4A is a sectional view illustrating a state in which the developing cartridge tray 60 is pulled out from the printer main body 100A. FIG. 4B is a perspective view illustrating a state in which the tray 60 is pulled out from the printer main body 100A. As illustrated in FIG. 4A and FIG. 4B, the tray 60 detachably supports the plurality of developing cartridges 30 to 33, and is constructed so as to be moved between an inside position I2 of the printer main body 100A (refer to FIG. 1B) and an outside position O2 (refer to FIG. 4A).

As illustrated in FIG. 4B, inside the printer main body 100A, a pair of the left fixed rail 61L and the right fixed rail 61R, in which the front-rear direction is a longitudinal direction of the rails, are arranged so as to be opposed with each other. The tray 60 is a frame type member. At an upper portion of the left side surface of the tray 60, a rib portion 60*b* of which a longitudinal direction is the front-rear direction is provided. The rib portion 60*b* is fitted and inserted into a guide groove portion 61*a*, which is provided inside the fixed rail 61L and is extended in the front-rear direction. On an upper portion of the right side surface of the tray 60, the rib portion 60*a* of which a longitudinal direction is the front-rear direction is provided. The rib portion 60*a* is fitted and inserted into a guide groove portion 61*a*, which is provided inside a fixed rail (not shown) and is extended in the front-rear direction. With this structure, the tray 60 is supported with respect to the printer main body 100A between the fixed rails 61L and 61R, and is slidable by being slid in the guide groove portions 61*a* (in a direction indicated by the arrow of FIG. 4B).

Figure 5A:
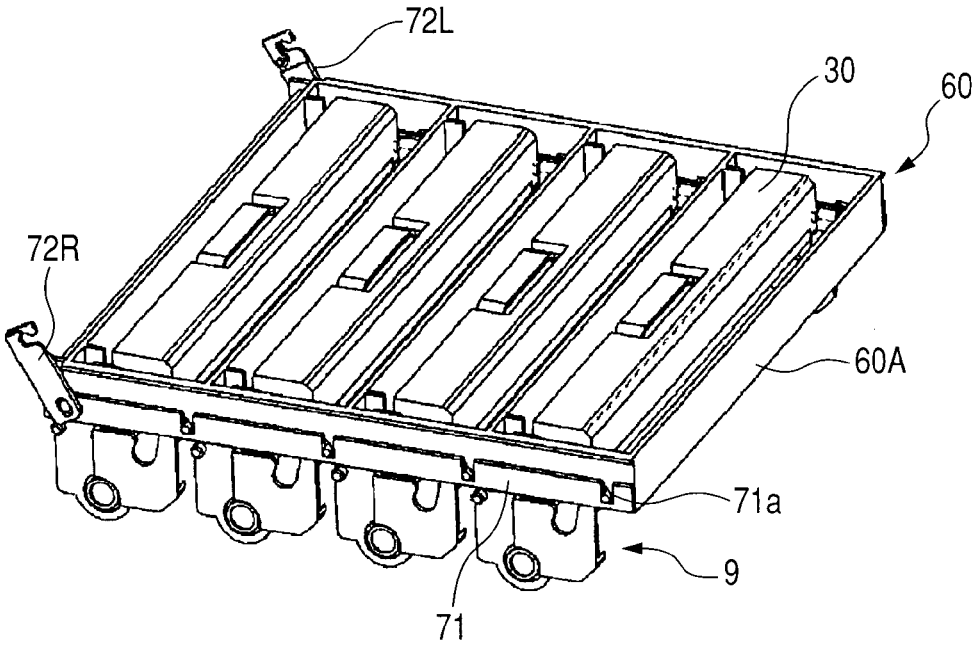
FIGS. 5A and 5B are perspective views for illustrating a position relation between the developing cartridge tray and the drum cartridges.
Figure 5B:
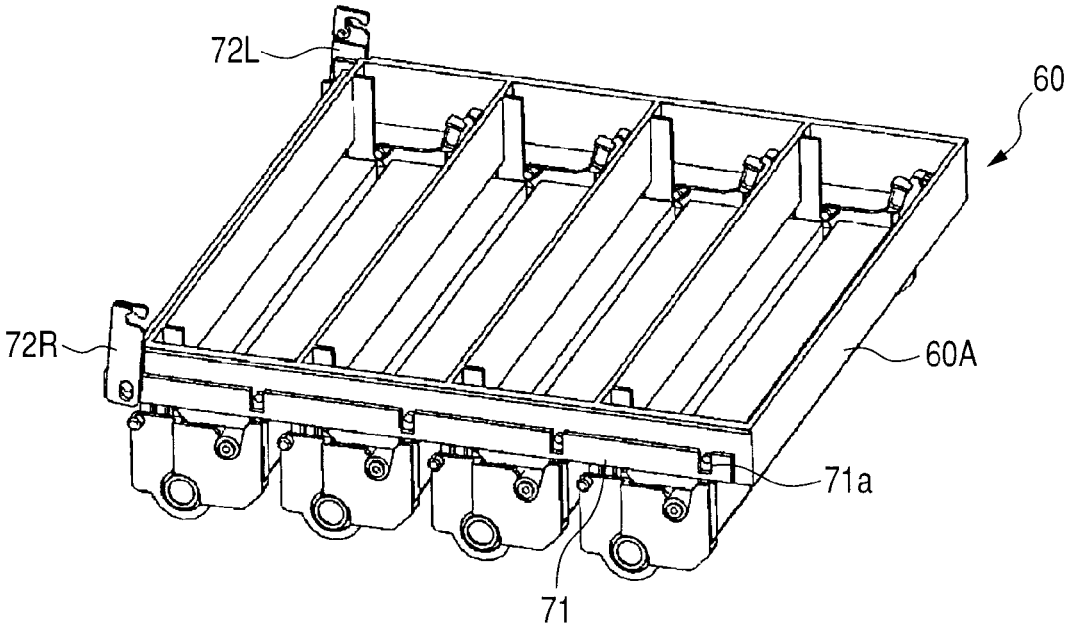

FIGS. 5A and 5B are perspective views for illustrating a position relation between the developing cartridge tray 60 and the drum cartridges 9. FIG. 5A is a perspective view illustrating a state in which the cartridges 30 are supported by the tray 60. FIG. 5B is a perspective view illustrating a state in which the cartridges 30 fall down from the tray 60, and the cartridges 30 are combined with the cartridge 9 (a positioned state).

As illustrated in FIG. 5A, link portions 71 are provided on the right and left side surfaces of a tray main body 60A. Further, a lock arm 72R and a lock arm 72L are provided on the right and left side surfaces of the tray main body 60A on the side of the outside position O2. From a state illustrated in FIG. 5A to a state illustrated in FIG. 5B, the arms 72R and 72L are rotated clockwise. Then, the link portions 71R and 71L are moved to the left side direction. With this operation, the cartridges 30 are moved downward by the below-mentioned mechanism. From a state illustrated in FIG. 5B to a state illustrated in FIG. 5A, the arms 72R and 72L rotate in a counter clockwise direction. Then, the link portions 71R and 71L are moved rightward. With this operation, the cartridge 30 is raised by the below-mentioned mechanism.

Figure 6:
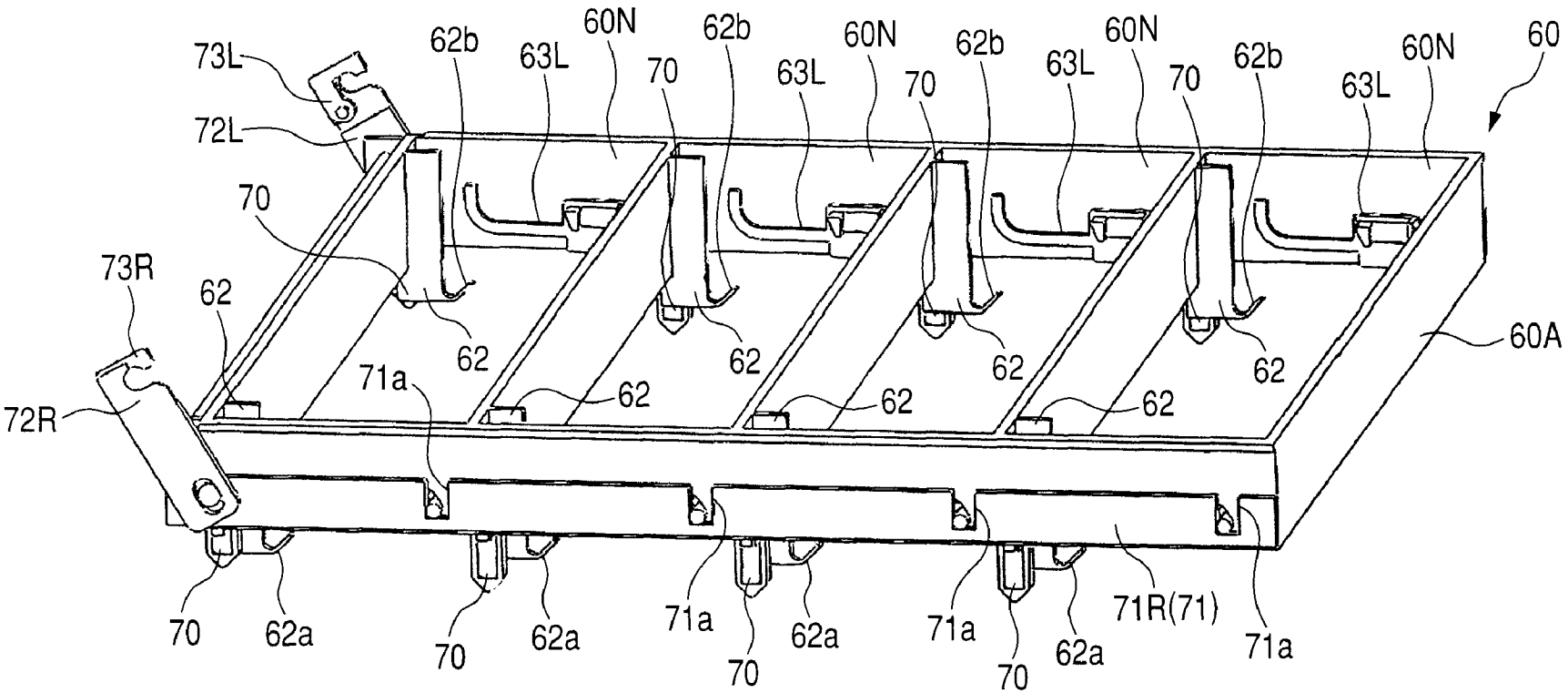
FIG. 6 is a perspective view of the developing cartridge tray.

FIG. 6 is a perspective view of the tray 60. As illustrated in FIG. 6, a hooking member 62 is provided on the left side inside each station of the tray 60. A hook shape groove portion 62*b* for supporting one end side of the cartridge 30 is provided on the hooking member 62. Further, a hooking member 62 is provided on the right side (not shown) inside of each station of the tray 60, too. A hook shape groove portion 62*a* for supporting the other end side of the cartridge 30 is provided on the hooking member 62. The groove portions 62*a* and 62*b* are provided in right and left symmetry.

As illustrated in FIG. 6, in each station of the tray main body 60A, a lever portion 63L which is received by a bearing on the left inside surface 60N and a lever portion (not shown) which is received by a bearing on the right inside surface (not shown) are provided. The lever portion 63L of the left inside surface 60N and the lever portion of the right inside surface are provided bilaterally symmetric. In addition, the tray main body 60A includes pressure members (second pressure members) 70 extending downward from right and left lower ends in each station.

Note that, although described above, as illustrated in FIG. 6, on the right and left side surfaces of the tray main body 60A, the link portions 71L and 71R are provided slidably toward the outside position O and the inside position I. The link portions 71L and 71R are provided with link portion grooves 71*a* corresponding to the stations, respectively. On the side of the outside position O of the tray main body 60A, the arms 72L and 72R and lock arm claws 73L and 73R, which are integrally formed, are provided bilaterally symmetric.

Figure 7A:
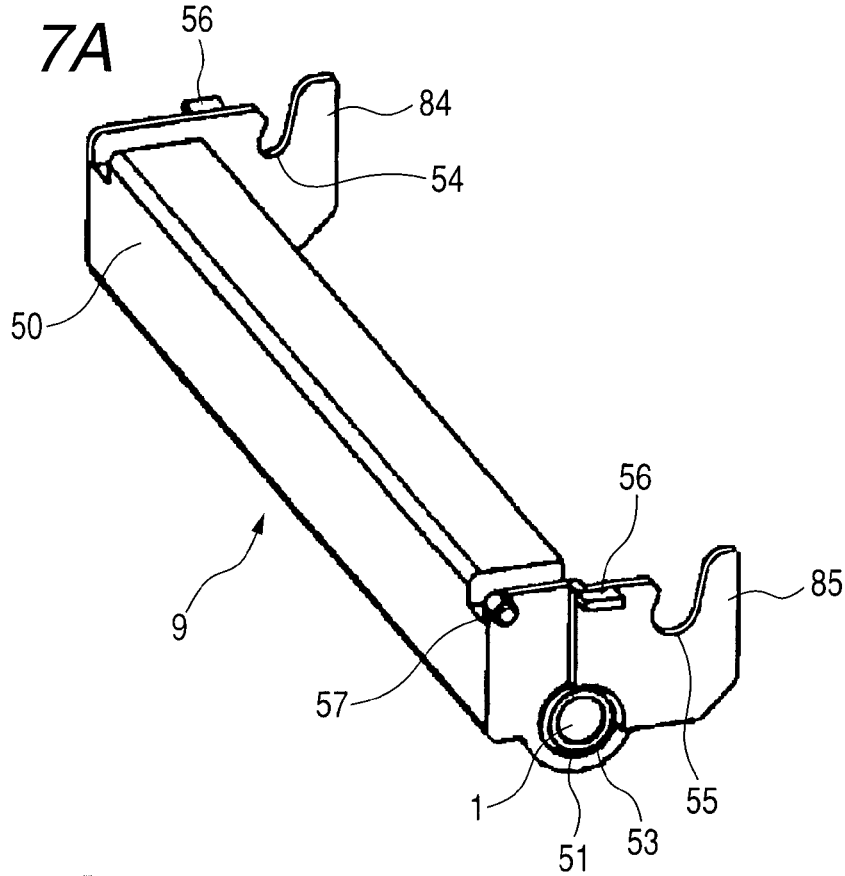
FIGS. 7A and 7B are perspective views each illustrating structures of the drum cartridge and the developing cartridge.

FIG. 7A is a perspective view illustrating a structure of the cartridge 9.

As illustrated in FIG. 7A, the cartridge 9 has a drum cartridge frame 50, support members 84 and 85, and the photosensitive drum 1. In the cartridge 9, an axial direction of the photosensitive drum 1 is defined as a right and left direction, and the cartridge 9 is an assembly of a longitudinal box-shape having a longitudinal direction as the right and left direction. On each of the right and left side surfaces of the frame 50, the support members 84 and 85 for supporting the photosensitive drum 1 and the cartridge 30, are provided. The support member 85 as the right side surface portion is provided with a bearing portion 51 and a recess portion (an engaged portion) 55. The support member 84 as the left side surface portion is provided with a bearing portion (not shown) and a recess portion (an engaged portion) 54. On the upper portion of each of the support members 84 and 85, an eave portion 56 projecting extendedly outwards in the right or left direction is provided. Although described later, the boss portions (engaging portions) 43 are provided on the cartridge 30. Correspondingly to this, as illustrated in FIG. 7A, the recess portions (the engaged portions) 54 and 55 adapted for engaging with the boss portions 43 are provided in the cartridge 9.

The photosensitive drum 1 is rotatably supported by the bearing portion 51. The bearing portion 51 has a coupling fitting portion (a drum drive input portion) 53. Further, projecting portions 57 are provided on the support members 84 and 85 fixed to the right and left side surfaces of the frame 50. The projecting portions 57, under a state in which the cartridge 9 is inserted into (supported by) the tray 26, regulate the attitude of the cartridge 9 to prevent the cartridge 9 from tilting in the front-rear direction.

Figure 7B:
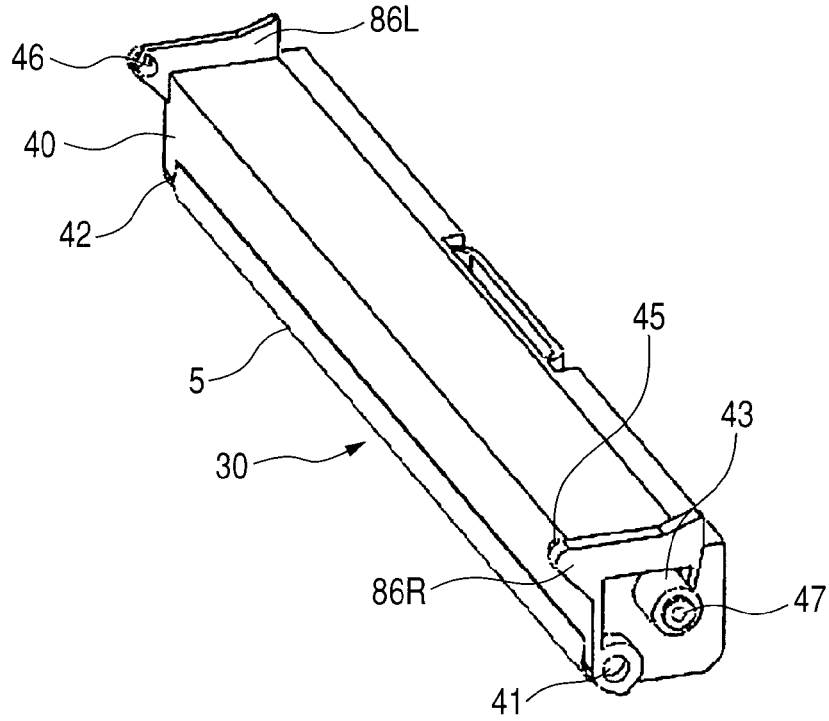

FIG. 7B is a perspective view illustrating a structure of the developing cartridge 30. As illustrated in FIG. 7B, the cartridge 30 has, as well as the cartridge 9, a developing cartridge frame 40, support members 86R and 86L, and the developing roller. In the cartridge 30, an axial direction of the developing roller 5 is defined as a right and left direction, and the cartridge 30 is an assembly of a longitudinal box-shape having a longitudinal direction as the right and left direction. On each of the right and left side surfaces of the frame 40, the support members 86R and 86L are provided. The support member 86R is provided with a bearing portion 41 and a boss portion (an engaging portion) 43, and a shaft 45 projecting inwards at a corner of the support member 86R. The shaft 45 is adapted to be hooked to the above-mentioned groove portion 62*a* (refer to FIG. 6).

The left side surface portion of the frame 40 is also formed similarly to the right side surface portion. That is, the above-mentioned bearing portion 41, the boss portion (the engaging portion) 43, and the shaft 45 are arranged symmetric on each of the right and left of the cartridge 30. Further, those are similarly provided on the support member 86L. In this case, the shaft 45 corresponds to the shaft 46 on the support member 86L. The shaft 46 is adapted to be hooked to the above-mentioned groove portion 62*b* (refer to FIG. 6).

Further, as illustrated in FIG. 7B, the developing roller 5 is rotatably supported between the bearing portions 41. Further, the boss portions 43 has a coupling fitting portion (a development drive input portion) 47 for driving the developing roller 5.

Figure 8:
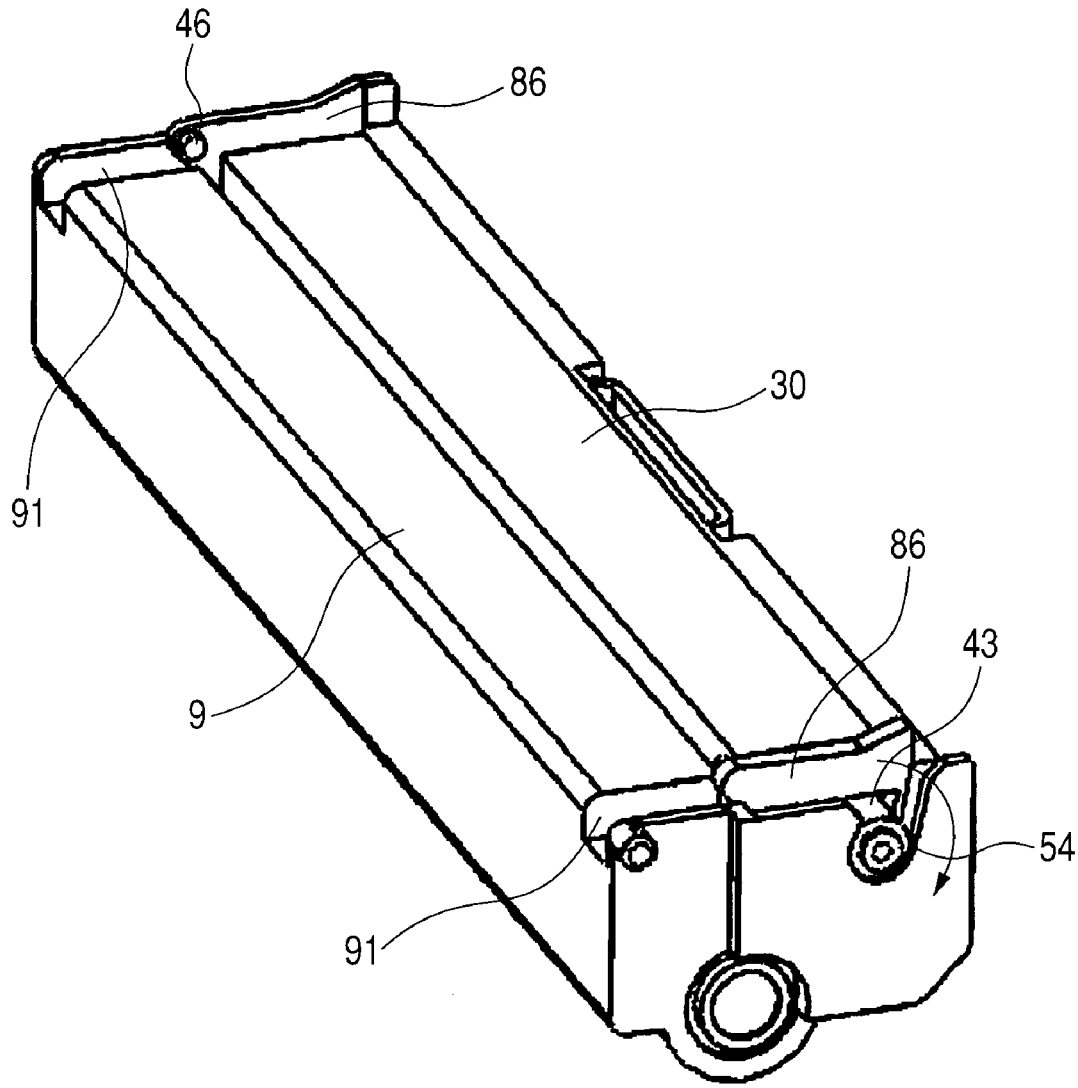
FIG. 8 is a perspective view illustrating a state in which the developing cartridge is combined with the drum cartridge.

FIG. 8 is a perspective view illustrating a state (a positioned state) in which the cartridge 30 is combined with the cartridge 9. As illustrated in FIG. 8, during an operation state, on the right side surface side of the cartridge 30, the boss portion 43 engages with the substantially U-shaped recess portion 54 of the cartridge 9 to be positioned. At the same time, on the left side surface of the cartridge 30, the boss portion (not shown) engages with the substantially U-shaped recess portion 55 of the cartridge 9 to be positioned. Thus, the cartridge 30 becomes rotatable about the boss portion 43 on the right side surface and the boss portion (not shown) on the left side surface as a center.

The shafts 45 and 46 having symmetric shapes of the cartridge 30 are pivotal centers when the cartridge 30 is engaged with the cartridge 9, and the description of the operation thereof will be described later.

Figure 9A:
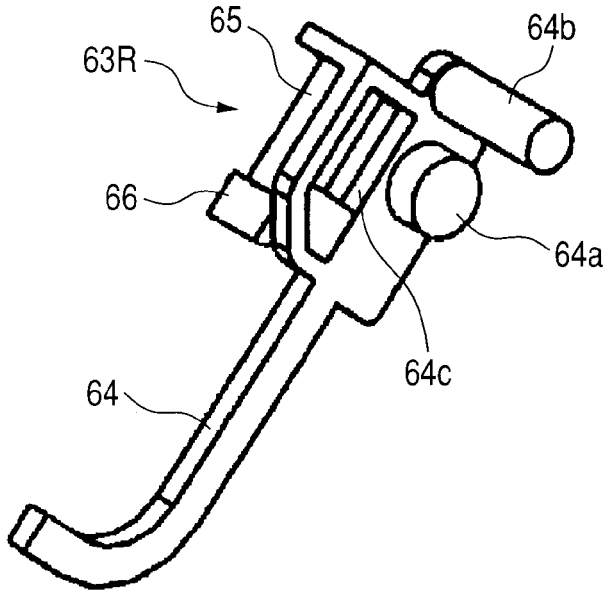
FIG. 9A is a perspective view illustrating a structure of a lever portion.

FIG. 9A is a perspective view illustrating a structure of a lever portion 63R. As illustrated in FIG. 9A, the lever portion 63R has a holding arm 64, a pressure spring 65, and a pressure pin 66. A holding arm shaft 64*a*, a holding arm boss portion 64*b*, and a holding arm groove portion 64*c* are provided on the arm 64. The pin 66 is fitted into a groove portion 64*c*, and is urged by the spring 65.

Figure 9B:
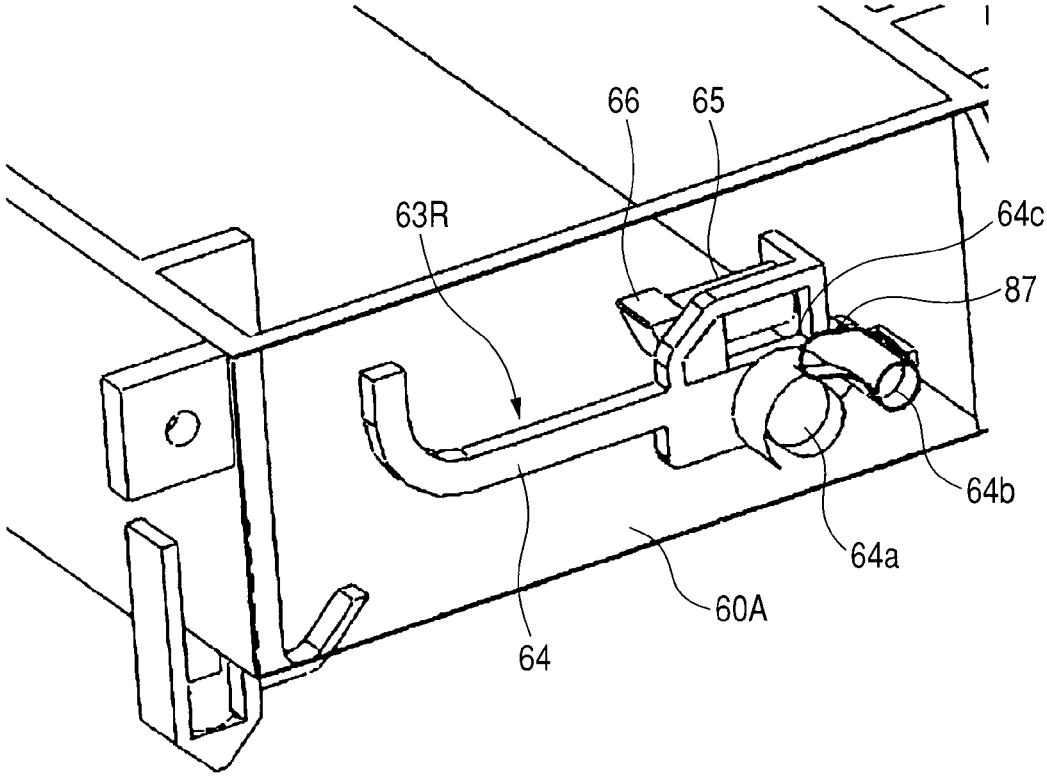
FIG. 9B is an enlarged view of a tray main body to which the lever portion is provided.

FIG. 9B is an enlarged view of the tray main body 60A, to which the lever portion 63R is provided. As illustrated in FIG. 9B, the shaft 64*a* is received by a bearing on the inside of the side surface of the tray main body 60A. The boss portion 64*b* is inserted into an elongated hole formed in the side surface of the tray main body 60A in each station, and is engaged with the link portion groove 71*a* (refer to FIG. 6). The arms 72R and 72L (refer to FIG. 5A, FIG. 5B, and FIG. 6), the link portion 71 (refer to FIG. 5A, FIG. 5B, and FIG. 6), and the lever portions 63R and 63L (refer to FIG. 9B) constitute a positioning mechanism.

With this structure, when the door 28 is moved to the open position Q, the link portions 71R and 71L is moved to the inside position I side. In this case, the boss portions 64*b* are guided by the groove portions 71*a*. Then, through the rotation of the lever portions 63R and 63L, the cartridges 30 are rotated and moved upward. Then, the engagements between the boss portions 43 and the recess portions 54 are released. With this operation, the cartridges 30 are supported by the tray 60.

When the door 28 is moved to the closed position P, the link portions 71R and 71L is moved to the outside position O side. In this case, the boss portions 64*b* are guided by the groove portions 71*a*. Then, through the rotation of the lever portions 63R and 63L, the cartridges 30 are rotated and moved downward. With this operation, the boss portions 43 are engaged with the recess portions 54. With this operation, the cartridges 30 are positioned to an image formation available position G at which image formation can be performed.

Figure 10A:
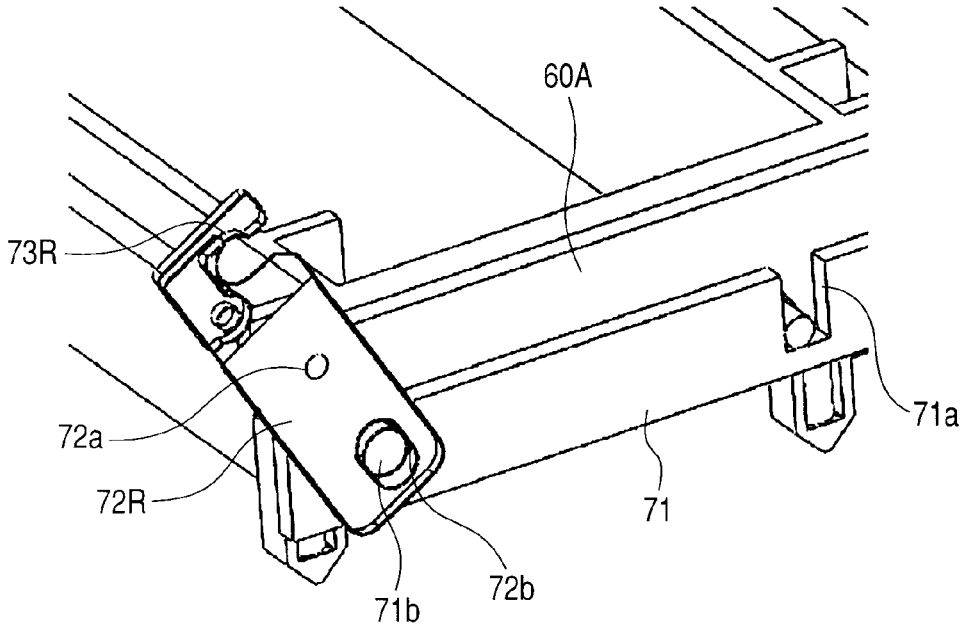
FIGS. 10A and 10B are enlarged perspective views illustrating a structure of the tray main body to which a lock arm is attached.

FIG. 10A is an enlarged perspective view illustrating a structure of the tray main body 60A, to which the arm 72R is attached. As illustrated in FIG. 10A, the arm 72R has the shaft 72*a*, and an elongated hole portion 72*b*. On the other hand, at the forward portion of the tray 60, a shaft rotation support portion 88 (refer to FIG. 10B) is provided. The support portion 88 has a hole 88*a* (refer to FIG. 10B) formed therein. The shaft 72*a* is inserted into the hole 88*a* to be rotatably supported.

Further, on the outside position O2 side of the link portion 71, the shaft 71*b* is provided. The hole portion 72*b* is inserted into the shaft 71*b*. With this structure, when the arm 72R rotates, the link portion 71 slides in the front-rear direction.

Figure 10B:
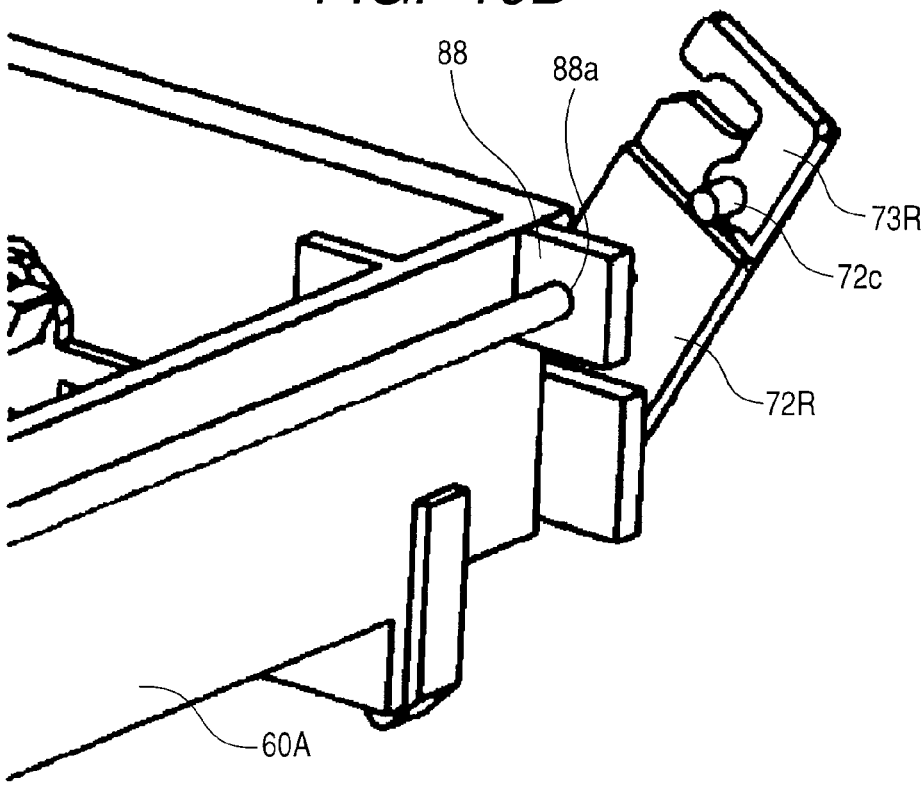

FIG. 10B is an enlarged perspective view, which is viewed from another direction, for illustrating a structure of the tray main body 60A, to which the arm 72R is attached. As illustrated in FIG. 10B, the boss portion 72*c* is provided to the upper portion of the arm 72R. The lock arm claw 73R is rotatably attached to the boss portion 72*c*, which is urged by a spring (not shown). A cam portion 74R provided on the door 28 abuts against the boss portion 72*c*. With this structure, the boss portion 72*c* is rotated. The operation of the boss portion 72*c* will be described.

Figure 11:
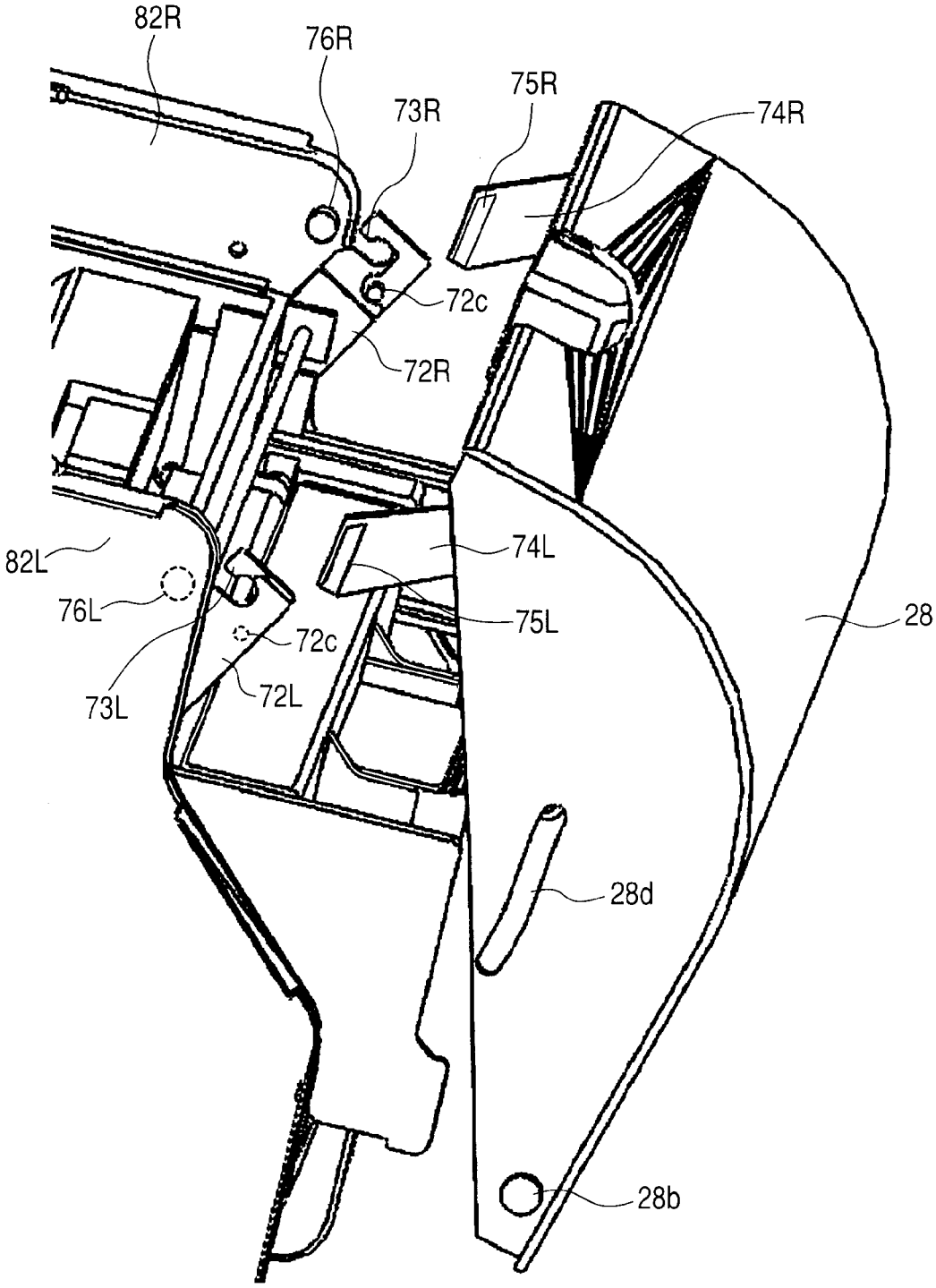
FIG. 11 is a perspective view illustrating a position relation between a front door and the lock arm.
Figure 12A:
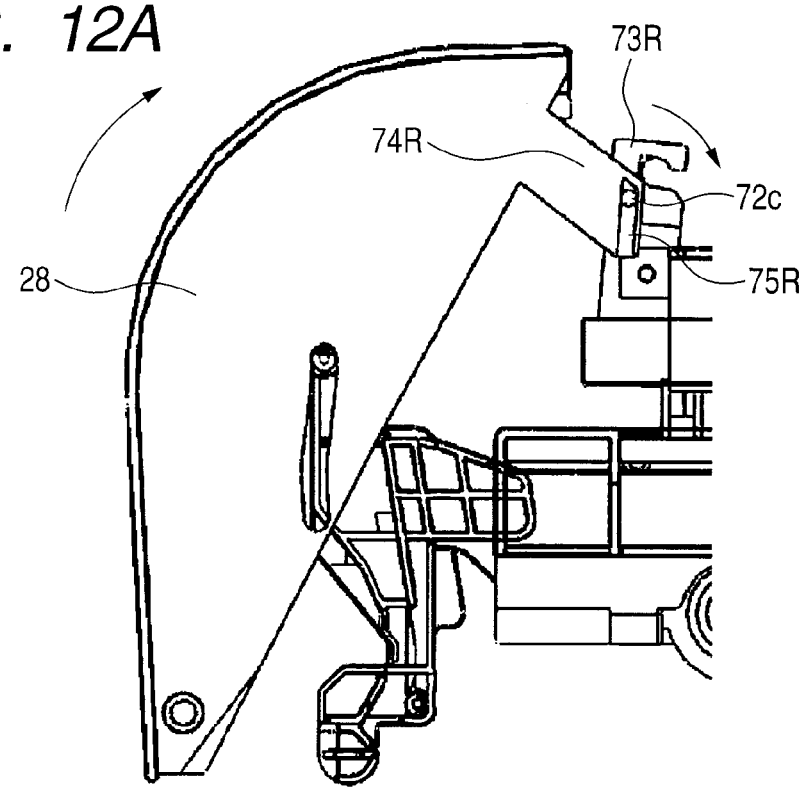
FIGS. 12A and 12B are sectional views illustrating a position relation between the front door and the lock arm, and illustrating operation when the front door is closed and opened.
Figure 12B:
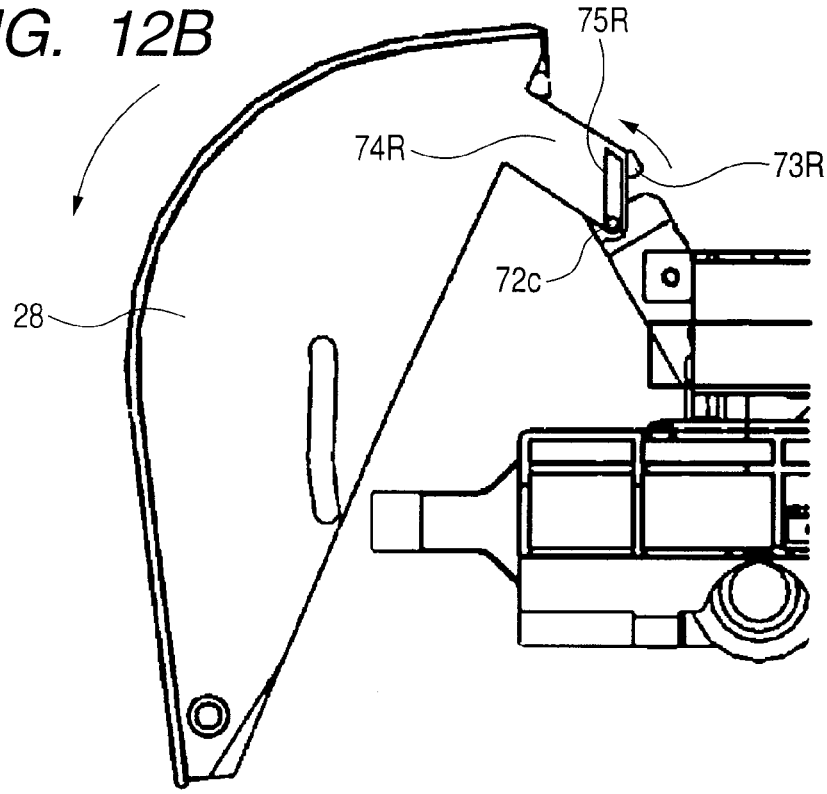

FIG. 11 is a perspective view illustrating a position relation between the door 28 and the arm 72R. FIG. 12A is a sectional view illustrating a position relation between the door 28 and the arm 72R, and illustrating an operation when the door 28 is closed. FIG. 12B is a sectional view illustrating a position relation between the door 28 and the arm 72R, and illustrating an operation when the door 28 is opened.

As illustrated in FIG. 11, the door 28 has cam portions 74L and 74R on both side surfaces thereof. The cam portions 74L and 74R have groove portions 75L and 75R, respectively. Further, a lock pin 76R is provided on the right frame 82R. Further, a lock pin 76L is provided on the left frame 82L. The grove portions 75R and 75L correspond to the boss portions 72*c* of the arms 72R and 72L, respectively. The lock arm claws 73R and 73L correspond to the lock pins 76R and 76L, respectively.

As illustrated in FIG. 12A, when the door 28 is closed, the boss portion 72*c*, which engages with the groove portion 75R provided to the cam portion 74R, is pressed. With this operation, the arm 72R is rotated clockwise. Thus, the arm claw 73R is engaged with the lock pin 76R. As illustrated in FIG. 12B, the door 28 is opened. Then, the boss portion 72*c*, which is engaged with the groove portion 75R provided to the cam portion 74R, is pulled. With this, the arm 72R is rotated in a counter clockwise direction. Thus, the arm claw 73R is disengaged from the lock pin 76R.

Figure 13A:
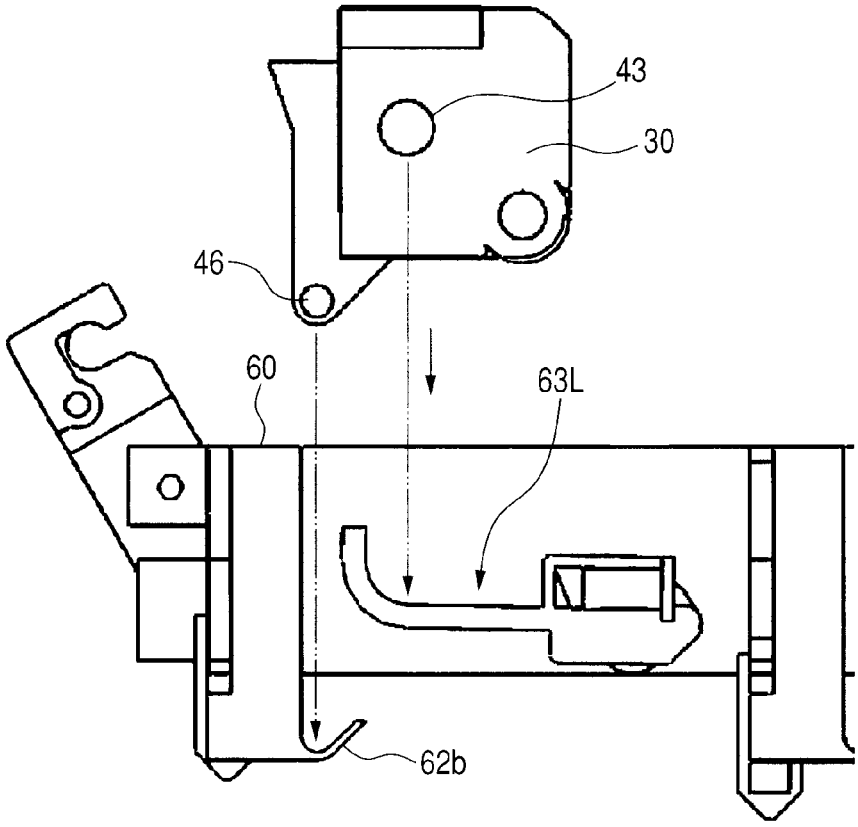
FIG. 13A is a sectional view illustrating a step just before the developing cartridge is supported by the developing cartridge tray.
Figure 13B:
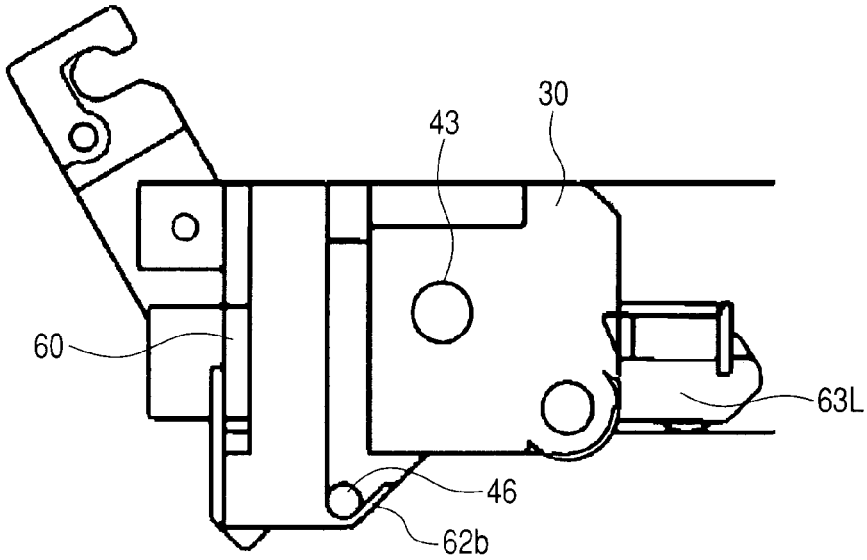
FIG. 13B is a sectional view illustrating a state in which the developing cartridge is being supported by the developing cartridge tray.

FIG. 13A is a sectional view illustrating a step just before the cartridge 30 is supported by the tray 60. FIG. 13B is a sectional view illustrating a state in which the cartridge 30 is being supported by the tray 60. As illustrated in FIG. 13A, the cartridge 30 is inserted into the tray 60 from above. Then, as illustrated in FIG. 13B, the cartridge 30 is fallen down so that the shaft 46 is hooked to the groove portion 62*b*, and further, the left side surface side boss portion is mounted on the lever portion 63L. Thus, the cartridge 30 is supported by the tray 60.

Figure 14A:
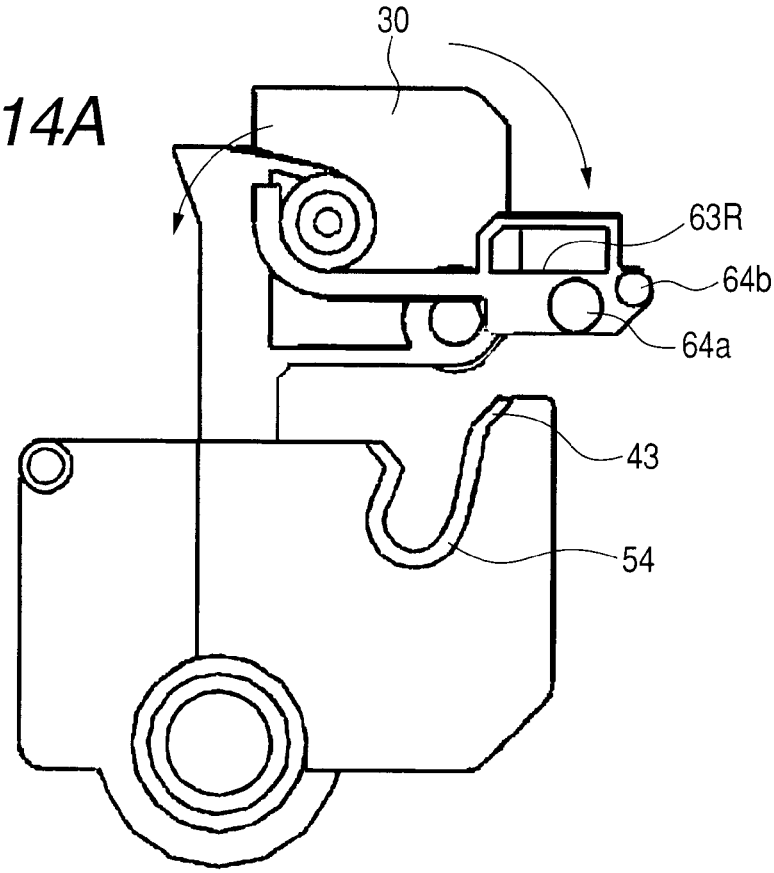
FIG. 14A is an enlarged side view illustrating a state when a lever portion starts to rotate.

FIG. 14A is an enlarged side view illustrating a state when the lever portion 63R starts to rotate. As illustrated in FIG. 14A, the lever portion 63R starts the counterclockwise rotation about the shaft 64*a* as a center. Then, the cartridge 30 is rotated clockwise.

Figure 14B:
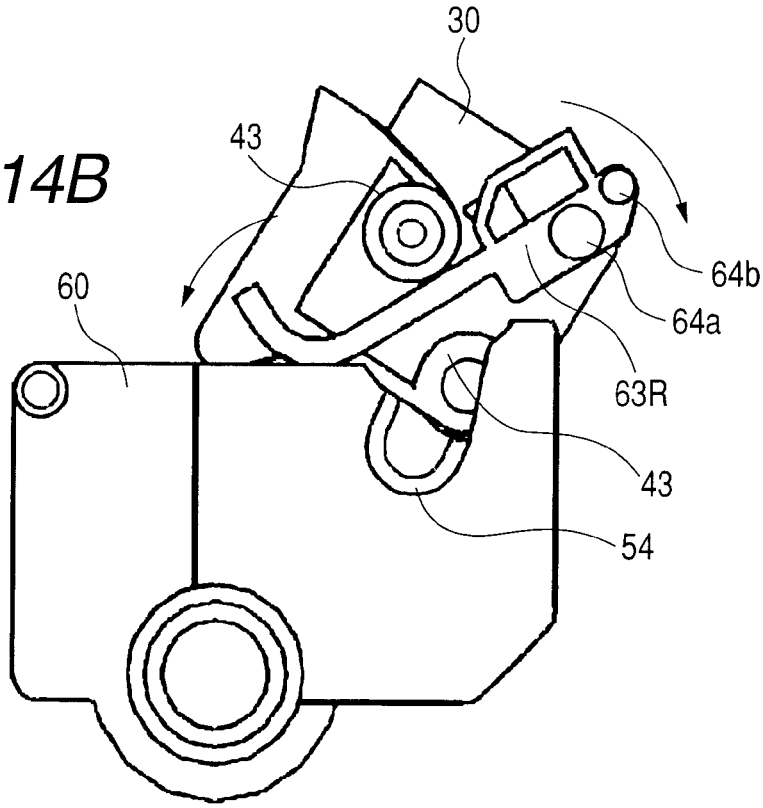
FIG. 14B is an enlarged side view illustrating a state in which the lever portion is being rotated.

FIG. 14B is an enlarged side view illustrating a state in which the lever portion 63R is being rotated. As illustrated in FIG. 14B, the boss portion 43 pushes down the lever portion 63L. Then, the lever portions 63L and 63R are rotated counterclockwise about the shafts 64*a* as a center. Then, the cartridge 30 is further rotated clockwise by being guided by the lever portions 63L and 63R about the shafts 45 and 46 as the centers.

Figure 15A:
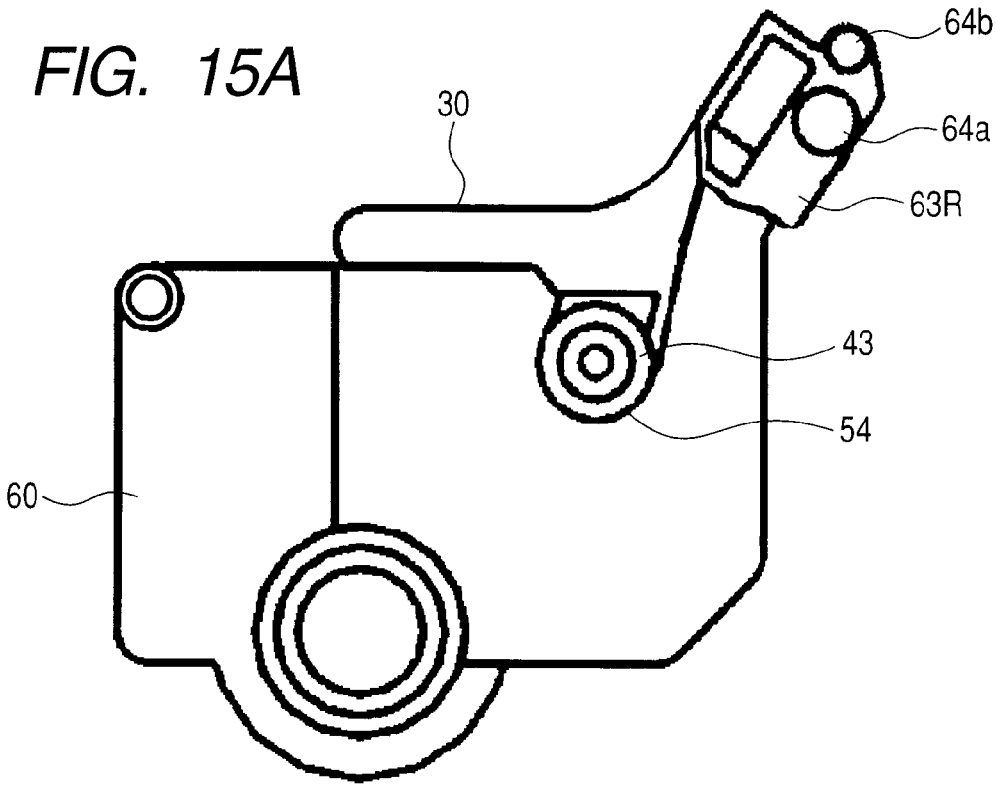
FIG. 15A is an enlarged side view illustrating a state in which the rotation of the lever portion is ended.

FIG. 15A is an enlarged side view illustrating a state in which the rotation of the lever portion 63R is ended. As illustrated in FIG. 15A, the boss portion 43 is engaged with the substantially U-shaped recess portion 54 of the cartridge 9. The cartridge 30 is combined (positioned) with the cartridge 9. At this time, the pressure pins 66 (refer to FIG. 9B and FIG. 10A) provided to the lever portions 63L and 63R, the cartridge 30 is pressed to the cartridge 9. In this case, the positioning position of the cartridge 30 also becomes a pivotal center.

As described above, the cartridge 30 and the cartridge 9 are combined with each other (when being positioned), the pressure pin (a rotation direction pressure member as a first pressure member) 66 presses the cartridge 30 against the cartridge 9 by a predetermined pressure. Then, the lever portions (the first pressure members) 63R and 63L are provided in the tray 60. Note that, in this case, the shafts 45 and 46 and the groove portions 62*a* and 62*b* are in a spaced apart state.

Figure 15B:
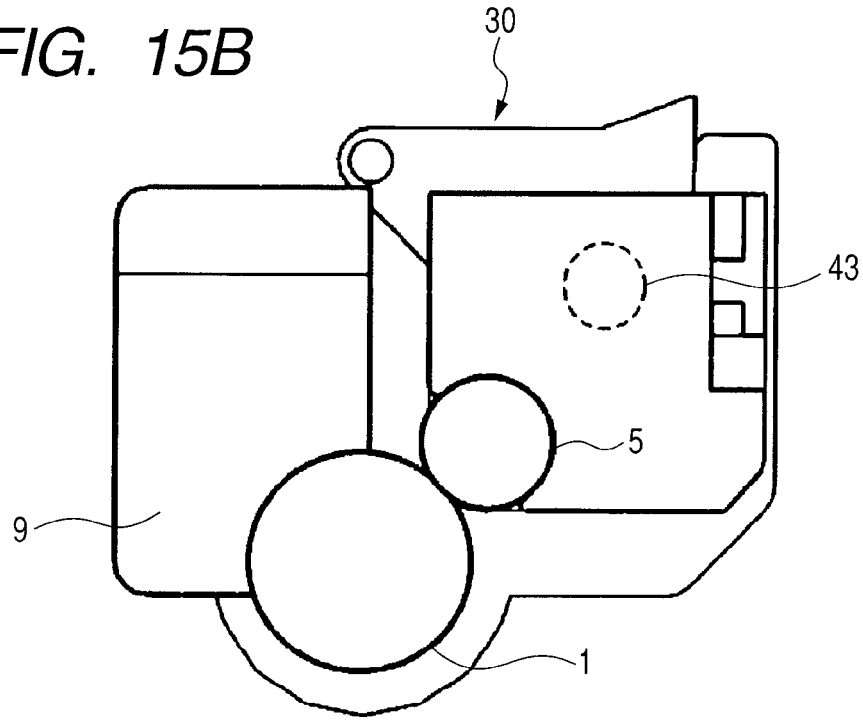
FIG. 15B is a side view illustrating a position relation between a photosensitive drum and a developing roller when the rotation of the lever portion is ended.

FIG. 15B is a side view illustrating a position relation between a photosensitive drum 1 and a developing roller 5*a* when the rotation of the lever portion 63L is ended. As illustrated in FIG. 15B, the cartridge 30 is pressed against the cartridge 9, and hence the developing roller 5 is positively positioned at a predetermined position with respect to the photosensitive drum 1.

Next, by referring to the drawings, a description will be provided of a step of replacing the cartridges 9 to 12 and the cartridges 30 to 33 inside the printer 100.

First, as illustrated in FIG. 1B, the door 28 is opened. With this operation, as illustrated in FIG. 12B, the groove portions 75L and 75R of the cam portions 74L and 74R of the door 28 are disengaged from the boss portions 72*c* of the arms 72L and 72R. As the arms 72R and 72L are pulled forward, the elongated hole portions 72*b* of the arms 72R and 72L are guided, respectively. Then, as illustrated in FIG. 11, the lock arm claws 73R and 73L are disengaged from the pins 76L and 76R, respectively. Then, the arms 72L and 72R each perform a forward rotation.

The arms 72L and 72R each rotate from a state illustrated in FIG. 5B to a state illustrated in FIG. 5A. With this rotation, the link portions 71L and 71R each perform a slide movement. With this movement, the lever portions 63L and 63R each rotate in order of the states as illustrated in FIG. 15A, FIG. 14B, and FIG. 14A. With this operation, the cartridges 30 to 33 are separated from the cartridges 9 to 12, respectively. Then, as illustrated in FIG. 4A, the tray 60 becomes movable while holding the cartridges 30 to 33. As the tray 60 is pulled out, the upper surfaces of the cartridges 30 to 33 are opened above, resulting in being capable of replacing the cartridges 30 to 33.

At the same time, along with the opening operation of the door 28, as illustrated in FIGS. 2A and 2B, the connecting arms 37L and 37R are also rotated. With this rotation, the rails 27L and 27R each move forward and upward at a predetermined amount. Then, the cartridges 9 to 12 get away from the transfer belt 18 together with the tray 26. Then, the photosensitive drums 1 to 4 each become a state separated from the transfer belt 18. Then, as illustrated in FIG. 3A, the tray 26 becomes a movable state while holding the cartridges 9 to 12. As the tray 26 is pulled out, the upper surfaces of the cartridges 9 to 12 are opened above. With this operation, the cartridges 9 to 12 each become replaceable.

When mounting the cartridges 9 to 12 and the cartridges 30 to 33 to the printer main body 100A, the tray 26 is pulled out first, and then the tray 60 is pulled out in order in accordance with reversed procedures. The cartridges 9 to 12 are mounted (supported) onto the tray 26, and then the cartridges 30 to 33 are mounted (supported) onto the tray 60. Then, each of the trays 26 and 60 is slid into inside the printer main body 100A to be contained (received).

Then, in association with the closing operation of the door 28, the arms 37L and 37R each are rotated. With this rotation, the tray 26 is moved downward. With this movement, the photosensitive drums 1 to 4 and the transfer belt 18 are brought into an abutment state. Simultaneously, the arms 72L and 72R are rotated, the link portions 71 are slid, and the lever portions 63L and 63R are rotated. With this operation, the cartridges 30 to 33 are engaged with the cartridges 9 to 12, respectively, to be pressed.

Figure 16:
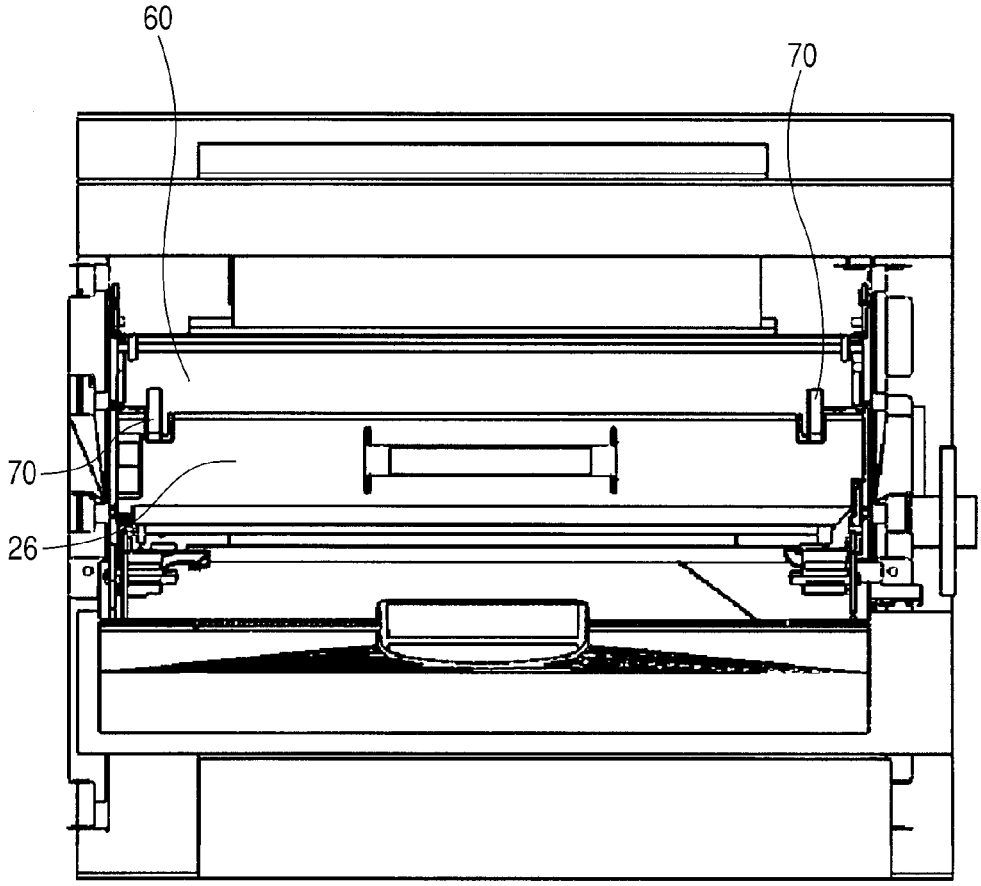
FIG. 16 is a frontal view, looking from a front side, of a printer in which a front door is opened.

FIG. 16 is a frontal view, looking from a front side, of a printer 100 in which a door 28 is opened. As illustrated in FIG. 16, the cartridges 9 to 12 supported by the tray 26 each are pressed by the pressure members 70 provided on the tray 60 at their both ends. The pressure members 70 (FIG. 6) each press respective recess portions 91 (FIG. 8). That is, the cartridge 9 and the transfer belt 18 are arranged so as to face with each other. Then, the pressure members (vertical direction pressure members as second pressure members) 70 press the cartridge 9 against the transfer belt 18 by a predetermined amount of pressure. The pressure members 70 are provided on the tray 60.

With this structure, the cartridges 30 to 33 are positively positioned with respect to the cartridges 9 to 12. Then, when both cartridges are to be replaced, through the operation of opening the door 28, the tray 26 and the tray 60 each become movable. With this, easy replacement of the cartridges can be realized.

According to the above-mentioned embodiment, when the door 28 is moved to the open position Q, the engagements between the boss portions 43 of the cartridges 30 to 33 and the recess portions 54 and 55 of the cartridges 9 to 12 are released. With this operation, the cartridges 30 to 33 are pulled out, and are located at the outside position O2. When the door 28 is moved to the closed position P, the boss portions 43 of the cartridges 30 to 33 and the recess portions 54 and 55 of the cartridges 9 to 12 are engaged, respectively. With this operation, the cartridges 30 to 33 are located at the image formation available position G at which image formation can be performed. Therefore, each of the cartridges 30 to 33 is positively positioned individually at each of the cartridges 9 to 12. As a result, the developing rollers 5 to 8 are positively positioned individually with respect to the photosensitive drums 1 to 4. With this, the cartridges 30 to 33 and the cartridges 9 to 12 may provide an equivalent image quality with that of the integral type cartridge.

In the printer 100, the cartridges are divided into the drum cartridges 9 to 12 and the developing cartridges 30 to 33. Then, the cartridges 9 to 12 are mounted on and dismounted from the tray 26, and the cartridges 30 to 33 are mounted on and dismounted from the tray 60. As described above, the cartridges are mounted on and dismounted from the separate support members, and hence any one of the cartridges 9 to 12 and the cartridges 30 to 33 is replaceable independently from another one thereof. Further, with one operation of opening the door 28, the cartridges 30 to 33 are separated from the cartridges 9 to 12, and the cartridges 9 to 12 are separated from the transfer belt 18. As a result, the improvement in operability and replaceability can be realized.

Further, by the action of the pressure pins 66, the cartridges 30 to 33 are positively positioned with respect to the cartridges 9 to 12.

In addition, by the action of the pressure member 70, the cartridges 30 to 33 are positively arranged above the cartridges 9 to 12, and then the cartridges 30 to 33 are fallen down. Then, the cartridges 30 to 33 are positively positioned with respect to the cartridges 9 to 12. Further, with the pressure members 70, the cartridges 9 to 12 are positively positioned with respect to the transfer belt 18.

As described above, according to the above-mentioned embodiment, when the door (the openable and closable member) 28 is moved to the open position, the engagements between the boss portions (the engaging portions) 43 of the developing cartridges 30 to 33 and the recess portions (the engaged portions) 54 and 55 of the drum cartridges (the process cartridges) 9 to 12 are released. With this, the developing cartridges 30 to 33 are positioned at positions so that the tray can be pulled out. Then, when the door 28 is moved to the closed position, the boss portions (the engaging portion) 43 and the recess portions (the engaged portion) 54 and 55 are engaged. With this, the developing cartridges 30 to 33 are positioned so that the image formation becomes possible. Accordingly, the respective developing cartridges 30 to 33 are positively positioned individually with respect to the respective drum cartridges 9 to 12. As a result, according to this embodiment, the developing rollers 5, 6, 7, and 8 can positively be positioned individually with respect to the electrophotographic photosensitive drums 1, 2, 3, and 4.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-069070, filed Mar. 19, 2009, which is hereby incorporated by reference herein in its entirety.

What is claimed is:

1. A color electrophotographic image forming apparatus, in which a plurality of drum cartridges are removably mounted to an apparatus main body to form an image on a recording medium, the color electrophotographic image forming apparatus comprising:

an opening provided in the apparatus main body;

an openable and closable member, which is moved between a closed position for closing the opening and an open position for opening the opening;

a plurality of drum cartridges each including an electrophotographic photosensitive drum;

a first cartridge supporting member, which removably supports the plurality of drum cartridges, and is moved between an inside position of the apparatus main body and an outside position of the apparatus main body through the opening;

a plurality of developing cartridges each including a developing roller, with each of the developing cartridges corresponding to one of the plurality of drum cartridges;

a second cartridge supporting member, which removably supports the plurality of developing cartridges, and is moved between an inside position of the apparatus main body and an outside position of the apparatus main body;

a transfer member, which is brought into contact with each electrophotographic photosensitive drum so that a toner image formed on each electrophotographic photosensitive drum is transferred from the electrophotographic photosensitive drum to the transfer member;

an engaging portion provided on each of the plurality of developing cartridges;

an engaged portion, which is engageable with the engaging portion, and is provided on each of the plurality of drum cartridges; and positioning means, which (i) releases, when the openable and closable member is moved from the closed position to the open position in a state in which the first cartridge supporting member and the second cartridge supporting member are positioned in the respective inside positions, an engagement between the engaging portion and the engaged portion, to allow the first cartridge supporting member and the second cartridge supporting member to be pulled out from the respective inside positions to the respective outside positions, and which (ii) engages, when the openable and closable member is moved from the open position to the closed position in the state in which the first cartridge supporting member and the second cartridge supporting member are positioned in the respective inside positions, the engaging portion with the engaged portion by rotating the plurality of developing cartridges, supported by the second cartridge supporting member, with respect to the second cartridge supporting member, so as to press each of the plurality of developing cartridges against the corresponding one of the plurality of drum cartridges with a rotation on the engaging portion to position the plurality of developing cartridges in positions in which the plurality of developing cartridges can serve an image formation.

2. A color electrophotographic image forming apparatus according to claim 1, further comprising a pressure member, which presses the plurality of developing cartridges against the plurality of drum cartridges by a predetermined pressure force.

3. A color electrophotographic image forming apparatus according to claim 2, wherein the pressure member is provided on the second cartridge supporting member.

4. A color electrophotographic image forming apparatus according to claim 1, further comprising a pressure member, which presses the plurality of drum cartridges against the transfer member by a predetermined pressure force.

5. A color electrophotographic image forming apparatus according to claim 4, wherein the pressure member is provided on the second cartridge supporting member.

6. A color electrophotographic image forming apparatus according to claim 1, wherein a positioning of the developing cartridge is performed by a pivotal center.

* * * * *